US005962388A

United States Patent [19]

Sherry et al.

[11] Patent Number: 5,962,388

[45] Date of Patent: Oct. 5, 1999

[54] ACIDIC AQUEOUS CLEANING COMPOSITIONS

[75] Inventors: Alan Edward Sherry, Cincinnati; Jeffrey Lawrence Flora, Mason; Jason Michael Knight, Cincinnati, all of Ohio

[73] Assignee: The Procter & Gamble Company, Cincinnati, Ohio

[21] Appl. No.: 09/224,824

[22] Filed: Jan. 4, 1999

Related U.S. Application Data

[60] Provisional application No. 60/071,185, Jan. 12, 1998.

[51] Int. Cl.[6] ..... C11D 1/12; C11D 7/08; C11D 3/43

[52] U.S. Cl. ..... 510/238; 510/235; 510/362; 510/363; 510/397; 510/398; 510/414; 510/426; 510/432; 510/477; 510/492

[58] Field of Search ..... 510/235, 238, 510/362, 363, 397, 398, 414, 426, 432, 477, 492

[56] References Cited

U.S. PATENT DOCUMENTS

| | | | |
|---|---|---|---|
| 4,501,680 | 2/1985 | Aszman et al. | 252/142 |
| 4,759,867 | 7/1988 | Choy et al. | 252/143 |
| 4,803,008 | 2/1989 | Ciolino et al. | 252/162 |
| 5,486,307 | 1/1996 | Misselyn et al. | 252/174.24 |
| 5,583,265 | 12/1996 | Woo et al. | 568/622 |
| 5,750,482 | 5/1998 | Cummings | 510/182 |

*Primary Examiner*—Yogendra Gupta
*Assistant Examiner*—Charles Boyer
*Attorney, Agent, or Firm*—Robert B. Aylor

[57] ABSTRACT

Compositions described herein are aqueous detergent compositions, preferably hard surface cleaning compositions, which contain alkyl aryl sulfonate surfactant, selected hydrophobic cleaning solvent, polycarboxylic acid, and aqueous solvent system in solution and/or a micellar phase, the pH being from about 2 to about 4. The have excellent soap scum removal and hard water deposit removal properties and are easy to rinse. Such compositions optionally contain additional anionic sulfate surfactant, cationic surfactant, peroxide and/or hydrophilic polymer for additional benefits.

24 Claims, No Drawings

ACIDIC AQUEOUS CLEANING COMPOSITIONS

This application claims benefit of Provisional Application Ser. No. 60/071,185 filed Jan. 12, 1998.

FIELD OF THE INVENTION

This invention relates to liquid detergent compositions for use in cleaning hard surfaces, particularly bathroom surfaces. Such compositions typically contain detergent surfactants, solvents, builders, etc.

BACKGROUND OF THE INVENTION

The use of solvents and organic water-soluble synthetic detergent surfactants for cleaning hard surfaces is well established. Known liquid detergent compositions comprise organic cleaning solvents, detergent surfactants, and optional detergent builders and/or abrasives.

Liquid cleaning compositions have the great advantage that they can be applied to hard surfaces in neat or concentrated form so that a relatively high-level of, e.g., surfactant material and/or organic solvent is delivered directly to the soil. Therefore, liquid cleaning compositions have the potential to provide superior soap scum, grease, and oily soil removal as compared to dilute wash solutions, e.g., those prepared from powdered cleaning compositions.

The present invention provides aqueous acidic hard surface cleaning compositions suitable for removal of soils commonly encountered in the bathroom, said compositions having specific mixtures of surfactants, solvents, and organic acids. These acidic hard surface cleaning compositions remove soap scum and hard water marks. The compositions can have disinfectant properties achieved through the choice of actives, including citric acid and cationic surfactants, and can be used with or without additives such as hydrogen peroxide for additional mold/mildew prevention benefits. Further, the compositions can advantageously incorporate one or more hydrophilic polymers for improved surface wetting and filming/streaking properties.

SUMMARY OF THE INVENTION

The hard surface detergent cleaning compositions herein comprise:

a. from about 0.5% to about 5% alkyl aryl sulfonate detergent surfactant;

b. from about 1% to about 8% of hydrophobic cleaning solvent selected from the group consisting of: di-propylene glycol mono-butyl ether; tri-propylene glycol mono-butyl ether; ethylene glycol mono-hexyl ether; and mixtures thereof;

c. optionally, from about 0.25% to about 4% of an anionic cosurfactant selected from the group consisting of: $C_8$–$C_{18}$ linear or branched alkyl sulfates; $C_8$–$C_{18}$ alkyl ethoxy sulfates; and mixtures thereof;

d. optionally, from about 0% to about 2% nonionic alcohol and/or cationic surfactant;

e. from about 2% to about 8% of water soluble polycarboxylic acid;

f. optionally, an effective amount, up to about 5%, of hydrogen peroxide;

g. optionally, an effective amount, up to about 0.5%, of a hydrophilic polymer selected from the group consisting of: xanthan gum; polystyrene sulfonate; polyvinyl pyrrolidone; polyvinyl pyrrolidone acrylic acid copolymer; polyvinyl pyridine; polyvinyl pyridine n-oxide; and mixtures thereof; and g. the balance an aqueous solvent system, and wherein the cleaning compositions are predominantly in micellar phase with a composition pH of from about 2 to about 4.

It is believed that the improved cleaning is a direct result of the selection of the specific surfactants, solvent and polycarboxylic acids.

DETAILED DESCRIPTION OF THE INVENTION

The compositions of the invention are especially useful for cleaning soils that are commonly encountered in the bathroom. These include dust particles, hard water stains, fatty acids, triglycerides, lipids, insoluble fatty acid soaps, and the like. The detergent compositions can be used on many different surface types, such as ceramic, fiber glass, polyurethane, and plastic surfaces.

a. The Alkyl Aryl Sulfonate:

Alkyl aryl sulfonates are an essential component of the invention. Due to their ubiquitous nature, such surfactants provide considerable cost advantages versus other anionic surfactants. Suitable alkyl aryl sulfonates can be neutralized with any alkali metal such as lithium, sodium, potassium and the like, or can alternatively be neutralized with an ammonium or $C_1$–$C_9$ ammonium salt derivative such as monoethanol amine, diethylamine, tri-isopropanol amine and the like. They can be produced via any suitable process, leading to the formation of either "low 2-phenyl" or "high 2-phenyl" derivatives, though the "low 2-phenyl" derivatives are generally preferred. Such surfactants are commercially available from several suppliers globally, including Witco Corporation (One American Lane, Greenwich, Conn. 06831), Stepan Company (Edens & Witnetka Rd, Northfield, Ill. 60093) and BASF Aktiengesellschaft (ESA/1550, D-67056 Ludwigshafen, Germany).

The detergent compositions according to the present invention are prepared with relatively low levels of active. Typically, compositions will comprise sufficient surfactant and solvent, as discussed hereinafter, to be effective as hard surface cleaners yet remain economical; accordingly they typically contain from about 0.5% to about 5% alkyl aryl sulfonate surfactant, more preferably from about 1% to about 4% alkyl aryl sulfonate surfactant, and even more preferably from about 1.2% to about 3% alkyl aryl sulfonate surfactant. It has been found that low levels of surfactant can also be advantageous to overall cleaning performance. Thus, at levels of alkyl aryl sulfonate higher than about 5%, hard water mark removal is observed to deteriorate. While not wishing to be limited by theory, it is believed that high levels of surfactant compete for surface sites with the polycarboxylic acid required in the present invention, thus inhibiting the action of the organic acid.

The alkyl aryl sulfonates of the invention have a chain length average of from about 8 carbon atoms to about 14 carbon atoms, more preferably from about 9 carbon atoms to about 13 carbon atoms, most preferably from about 9 carbon atoms to about 13 carbon atoms. The chain length distribution can vary from about 8 carbon atoms to about 16 carbons. Mixtures of linear and/or branched alkyl aryl benzene sulfonates are suitable.

Ammonium and sodium salts of $C_{11}$ to $C_{12}$ linear alkyl benzene sulfonates are most preferred in the context of the present invention. Examples of particularly preferred, commercially available sodium alkyl benzene sulfonates include Polystep A-13® available from Stepan, Calsoft L-40® slurry available from Pilot Chemical Company (11756 Burke Street, Santa Fe Springs, Calif.). and Witconate P1059® available from Witco Corporation (Greenwich, Conn.). Alternatively, the desired alkyl aryl sulfonate surfactant can be produced in-situ by neutralization of the corresponding alkyl aryl sulfonic acid. Examples of suitable alkyl aryl sulfonic acids include Biosoft® 100 available from Stepan Company, Calsoft LAS-99® available from Pilot Chemical, and Lutensit A-LABS® available from BASF AG in Germany.

b. The Hydrophobic Cleaning Solvent

The compositions can also contain one or more hydrophobic cleaning solvents at effective levels, typically no less than about 2%, and, at least about, in increasing order of preference about 2% and about 3%, and no more than about, in increasing order of preference, about 8% and about 6% by weight of the composition.

Good cleaning requires the use of the right hydrophobic cleaning solvent. By hydrophobic cleaning solvent, it is meant an agent which remove hydrophobic soils such as those commonly encountered in the bathroom. The hydrophobic cleaning solvent also can participate in the building of viscosity, if needed, and in increasing the stability of the composition. Such solvents typically have a terminal $C_3$–$C_6$ hydrocarbon attached to from one to three ethylene glycol or propylene glycol moieties to provide the appropriate degree of hydrophobicity and, preferably, surface activity. Examples of commercially available hydrophobic cleaning solvents based on ethylene glycol chemistry include monoethylene glycol n-hexyl ether (Hexyl Cellosolve® available from Union Carbide). Examples of commercially commercially available hydrophobic cleaning solvents based on propylene glycol chemistry include the di-, and tripropylene glycol derivatives of propyl and butyl alcohol, which are available from Arco Chemical, 3801 West Chester Pike, Newtown Square, Pa. 19073) and Dow Chemical (1691 N. Sweede Road, Midland, Mich.) under the trade names Arcosov® and Dowanol®. In the context of the present invention, preferred solvents are selected from the group consisting of ethylene glycol mono-hexyl ether, tripropylene glycol butyl ether and di-propylene glycol butyl ether; the ethylene glycol mono-hexyl ether and tripropylene glycol butyl ether are particularly effective when used in combination with di-propylene glycol butyl ether. "Butyl" includes both normal butyl, isobutyl and tertiary butyl groups. Di-propylene glycol butyl ether is most preferred cleaning solvent and is available under the trade names Arcosolv DPNB® and Dowanol DPnB®. Di-propylene glycol t-butyl ether is commercially available from Arco Chemical under the tradename Arcosolv PTB®. The amount of hydrophobic cleaning solvent can vary depending on the amount of other ingredients present in the composition, but should be present in concentrations of at least, in increasing order of preference, about 2% and 3%, and less than, in increasing order of preference, about 8, about 6%, and about 5%, by weight of the total composition.

The hydrophobic cleaning solvent is required to provide acceptable cleaning. It is believed that the solvent acts to remove soils that bind the other soils to the surface, or to loosen those soils so that they can be more easily reached and/or removed.

c. The Anionic Cosurfactant

The detergent compositions of the present invention optionally, but preferably include an anionic cosurfactant. Such surfactants typically comprise a hydrophobic chain containing from about 8 carbon atoms to about 18, preferably from about 10 to about 16, carbon atoms, and include a sulfate, sulfonate or carboxylate hydrophilic head group. Examples of suitable preferred anionic surfactants include linear or branched alkyl sulfate detergent surfactant (e.g., Stepanol AM® from Stepan), alkyl ethoxy sulfates (Witconate 7093° from Witco corporation, One American Lane, Greenwich, Conn.). It is found that linear and branched $C_8$–$C_{14}$ alkyl sulfate surfactants, in particular, are preferred as they offer improved hard water removal benefits, and can also improved soap scum cleaning. In the context of thickened compositions the alkyl sulfate surfactant also helps provide improved phase stability. While the optional anionic can be used advantageously to improve hard water performance, it is more expensive than LAS and can induce higher levels of suds. In general, the level of optional anionic surfactants in the compositions herein is from about 0.25% to about 4%, more preferably from about 0.5% to about 3.5%, most preferably from about 0.75% to about 3%, by weight of the composition.

d. The Non-ionic Alcohol or Cationic Surfactant

The detergent compositions of the present invention can optionally comprise one, or more nonionic alcohols, and/or cationic surfactants. The combination of the alkylaryl detergent surfactant with the alcohol and/or cationic can provide higher viscosity, as disclosed in copending provisional application Ser. No. 60/066,563, filed on Nov. 26, 1997, in the names of Alan E. Sherry, Jeffrey L. Flora, Jason M. Knight, and Zuchen Lin. Applicants claim the benefit of said application's filing date and incorporate said application by reference. Cleaning compositions comprising both nonionic alcohol and cationic surfactant can be employed. As used herein, "nonionic alcohol" means a linear or mono-branched nonionic alcohol comprising an average of from about 8 carbon atoms to about 16 carbon atoms, more preferably from about 9 carbon atoms to about 14 carbon atoms, most preferably from about 10 carbon atoms to about 13 carbon atoms. Examples of suitable nonionic alcohols include 2-butyl-1-octanol, 2-methyl-1-undecanol and dodecanol. Linear C10–13 nonionic alcohols are most preferred. Examples of preferred, commercially available nonionic alcohols include Neodol 1® and Neodol 23® available from Shell Chemical (1 Shell Plaza, Houston, Tex. 77252). It is believed that best results are achieved when the chain length of the nonionic alcohol most closely matches that of the alkyl aryl sulfonate surfactant. For this reason, nonionic alcohols comprising less than 8 carbon atoms or longer than 16 carbon atoms are not preferred in this invention. If present, the nonionic alcohol is present in effective concentrations not exceeding about 2%, more preferably in concentrations of 1.5% or less, most preferably in concentrations of 1.25% or less by weight of the composition.

Detergent compositions herein that do not contain a nonionic alcohol can contain one, or more, cationic surfactants. As used herein, cationic surfactants are those which at acidic pH behave substantially as cationic materials. The cationic surfactant is to creates viscosity via ion pairing with the alkyl aryl sulfonate surfactant disclosed hereinbefore. Cationic surfactants can also provide disinfectancy properties and can be selected so as to enhance such benefits. Preferred cationic materials are quaternary ammonium compounds that have at least one hydrophobic chain with lengths of from about 8 carbon atoms to about 16 carbon atoms, more preferably from about 10 carbon atoms to about 16 carbon atoms, most preferably from about 12 carbon atoms to about 14 carbon atoms. Suitable cationic surfactants include quaternary alkyl and alkyl benzyl ammonium salts (e.g., Bardac® 208M from Lonza Incorporated, 1717 Route 208, Fairlawn, N.J. 07410) and ethoxylated quaternary ammonium salts (e.g., Ethoquad® surfactants available from Akzo Nobel Chemicals, 300 South Riverside Plaza, Chicago, Ill.). Other cationic surfactants include ethoxylated amines (e.g., Ethomeen® surfactants available from Akzo Nobel Chemical), alkyl dimethyl betaines (e.g., Rewoteric AM DML-35® from Witco Corporation) or amido propyl betaines (e.g., Rewoteric AMB 15U® from Witco Corporation) and amine oxides (e.g., Barlox 10S® from Lonza Incorporated). Incorporation of quaternary ammonium surfactants is particularly preferred for compositions intended to deliver antibacterial, fungistatic and fungicidal properties. Quaternary ammonium surfactants are known in the art and include C10–16 alkyl tri-methyl ammonium, C8–14 di-alkyl dimethyl ammonium and C10–16 alkyl dimethylbenzyl ammonium derivatives and mixtures thereof. Suitable and commercially available C10–16 alkyl tri-methyl ammonium and C8–C14 di-alkyl dimethyl ammonium quaternaries are available from Witco corporation under the tradename Adogen®; suitable C10–16 alkyl dimethylbenzyl ammonium surfactants may be purchased from Lonza incorporated under the tradename Bardac®. The counter-ion of the quaternary ammonium surfactants may be any of those known in the art such as bromide, chloride or methyl sulfate. In compositions that additionally contain hydrogen peroxide, the preferred counter-ion is methyl sulfate.

The level of cationic surfactant in the compositions of the present invention is preferably no greater than about 2%, more preferably no greater than about 1.5%, most preferably no greater than about 1.25% by weight of the composition. Cationic surfactants can be used alone or in combination with nonionic alcohols for viscosity.

If present, the level of cationic surfactant plus nonionic alcohol comprises at least about 0.1%, more preferably at least 0.3%, most preferably at least about 0.5%, and still more preferably from about 0.5% to about 2.0%, by weight of the composition.

e. The Polycarboxylic Acid

For purposes of hard water stain removal, the compositions are acidic with a pH of from about 2 to about 4, more preferably about 3. Acidity is accomplished , at least in part, through the use of one or more organic acids that having a pKa of less than about 5, preferably less than about 4. Such organic acids also can assist in phase formation for thickening, if needed, as well as provide hard water stain removal properties. It is found that organic acids are very efficient in promoting good hard water removal properties within the framework of the compositions of the present invention. Lower pH and use of one or more suitable acids is also found to be advantageous for disinfectancy benefits. Examples of suitable organic acids include citric acid, tartaric acid, succinic acid, glutaric acid, adipic acid, and mixtures thereof. Such acids are readily available in the trade. Examples of more preferred acids include citric acid (available from Aldrich Corporation, 1001 West Saint Paul Avenue, Milwaukee, Wis.) and a mixture of succinic, glutaric and adipic acids available from DuPont (Wilmington, Del.) sold as "refined AGS di-basic acids". Citric acid is most preferred. The amount of organic acid in the compositions herein can be from about 1% to about 10%, more preferably from about 2% to about 8%, most preferably from about 3% to about 6% by weight of the composition.

f. Optional Source of Peroxide:

The compositions of the invention can contain peroxide such as hydrogen peroxide, or a source of hydrogen peroxide, for fuirther disinfectancy, flngistatic and fungicidal benefits. Peroxide is believed to enhance the longevity of the benefit because of its well known residuality and slow decomposition to produce radical species. The components of the present composition are substantially compatible with the use of peroxides. Preferred peroxides include benzoyl peroxide and hydrogen peroxide. These can optionally be present in the compositions herein in levels of from about 0.05% to about 5%, more preferably from about 0.1% to about 3%, most preferably from about 0.2% to about 1.5%.

When peroxide is present, it is desirable to provide a stabilizing system. Suitable stabilizing systems are known. A preferred stabilizing system consists of radical scavengers and/or metal chelants present at levels of from about 0.01% to about 0.5%, more preferably from about 0.01% to about 0.25%, most preferably from about 0.01% to about 0.10%, by weight of the composition. Examples of radical scavengers include anti-oxidants such as propyl gallate, butylated hydroxy toluene (BHT), butylated hydroxy anisole (BHA) and the like. Examples of suitable metal chelants include diethylene triamine penta-acetate, diethylene triamine penta- methylene phosphonate, hydroxyethyl diphosphonate and the like.

g. Optional Hydrotuhilic Polymer:

In a preferred embodiment, the compositions of the present invention can advantageously incorporate low levels of hydrophilic polymer. These polymers have been found to enhance water sheeting on surfaces and improve filming streaking as disclosed in copending provisional application Ser. No. 60/061,296, filed on Oct. 7, 1997, in the names of Nicola John Policicchio and Alan Edward Sherry. Applicants incorporate said application by reference. While not wishing to be limited by theory it is believed that such polymers hydrophilically modify ceramic surface thereby reducing water surface tension and inducing improved water sheeting on said surfaces. This sheeting effect allows for channeling of dissolved soils down shower walls in bathrooms, leading to lower residual soil levels. Hydrophilic polymers have also been shown to mitigate the surface spotting caused by surfactants, especially for compositions that additionally include quaternary ammonium surfactant. Preferred hydrophilic polymers to be used in conjunction with compositions of the present invention include xanthan gum, polystyrene sulfonate, polyvinyl pyrrolidone, polyvinyl pyrrolidone/acrylate copolymer, polyvinyl pyridine and polyvinyl pyridine n-oxide. For compositions that include optional hydrogen peroxide, the most preferred polymers are polyvinyl pyridine and polyvinyl pyridine n-oxide. The preferred polymers, if present, have an average molecular weight of from about 10,000 to about 5,000,000, more preferably from about 20,000 to about 1,000,000, most preferably from about 30,000 to about 500,000. The level of polymer desired to achieve the desired benefits is from about 0.001% to about 0.10%, more preferably from about 0.005% to about 0.075%, most preferably from about 0.01% to about 0.05%. The specific level of polymer depends on the formulators objective. Thus, while improved sheeting results from increased level of polymer, it is also found that hard water removal performance deteriorates.

Other Optional Surfactants and Solvents:

In addition to alkyl aryl sulfonates and preferred optional anionic surfactants disclosed above, the hydrophobic cleaning solvents, the compositions of the present invention preferably comprise other additional anionic surfactants such as paraffin sulfonates (Hostapur SAS® from Hoechst, Aktiengesellschaft, D-6230 Frankfiurt, Germany). alkyl ethoxy carboxylates detergent surfactant (Neodex® from Shell Chemical Corporation), and the like.

Nonionic detergent surfactants can also be present. Suitable nonionic detergent surfactants for use herein are alkoxylated alcohols generally comprising from about 6 to about 16 carbon atoms in the hydrophobic alkyl chain of the alcohol. Typical alkoxylation groups are ethoxy and/or propoxy groups. Such compounds are commercially available under the series Neodol® from Shell, or Lutensol® from BASF AG with a wide variety of chain length and alkoxylation degrees. Preferred nonionic detergent surfactants for use herein are according to the formula $R(X)_nH$, were R is an alkyl chain having from about 6 to about 16 carbon atoms, preferably from about 6 to about 10, X is an alkoxy group, preferably ethoxy, or a mixture of ethoxy and propoxy groups, n is an integer of from about 4 to about 30 preferably about 5 to about 8. Other non-ionic surfactants that can be used include those derived from natural sources such as sugars and include alkyl polyglucosides (e.g., Simusol® surfactants from Seppic Corporation, 75 Quai d'Orsay, 75321 Paris, Cedex 7, France) and N-alkyl glucose amide surfactants. If present, the concentration of nonionic surfactant is from about 0.1% to about 3%, more preferably from about 0.1% to about 2%, by weight of the composition.

The compositions of the present invention can also include zwitterionic surfactants such as sulfobetaines and hydroxy sulfobetaines in effective concentrations preferably not exceeding about 2% by weight of the composition.

Other commercial sources of such surfactants can be found in McCutcheon's EMULSIFIERS AND DETERGENTS, North American Edition, 1997, McCutcheon Division, MC Publishing Company, also incorporated herein by reference.

h. The Aqueous Solvent System

The compositions are aqueous, comprising at least about 60% aqueous solvent by weight of the composition, more preferably from about 60% to about 90% by weight of the composition. The aqueous compositions are in micellar form, and do not incorporate substantial levels of water insoluble components that induce significant micellar swelling; the compositions are also adjusted to a final pH of from about 2 to about 4, preferably about 3.

The aqueous solvent system can also comprise low molecular weight highly water soluble solvents typically found in detergent compositions, e.g., ethanol, isopropanol, etc.

The compositions of the present invention can also include other solvents, and in particular paraffins and isoparaffins, which have been found to substantially reduce the suds created by the composition.

Optional components, such as perfumes and other conventional adjuvants can also be present.

Optional Perfume and Additional Adjuvants:

An optional, but highly preferred ingredient, is a perfume, usually a mixture of perfume ingredients. Indeed, perfume ingredients, which are typically hydrophobic materials, have been found to provide a contribution to building viscosity, perhaps through supporting the phase structure of the product, as well as improving the overall stability of the product. As used herein, perfume includes constituents of a perfume which are added primarily for their olfactory contribution.

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. The perfumes are preferably those that are more water-soluble and/or volatile to minimize spotting and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference.

Perfume components can be natural products such as essential oils, absolutes, resinoids, resins, concretes, etc., and/or synthetic perfume components such as hydrocarbons, alcohols, aldehydes, ketones, ethers, acids, acetals, ketals, nitriles, etc., including saturated and unsaturated compounds, aliphatic, carbocyclic and heterocyclic compounds. Examples of such perfume components are: geraniol, geranyl acetate, linalool, linalyl acetate, tetrahydrolinalool, citronellol, citronellyl acetate, dihydromyrcenol, dihydromyrcenyl acetate, terpineol, terpinyl acetate, acetate, 2-phenylethanol, 2-phenylethyl acetate, benzyl alcohol, benzyl acetate, benzyl salicylate, benzyl benzoate, styrallyl acetate, amyl salicylate, dimenthylbenzylcarbinol, trichloromethylphenycarbinyl acetate, p-tert.butylcyclohexyl acetate, isononyl acetate, alpha-n-amylcinammic aldehyde, alpha-hexylcinammic aldehyde, 2-methyl-3-(p-tert.butylphenyl)-propanal, 2-methyl-3(p-isopropylphenyl)propanal, 3-(p-tert.butylphenyl)propanal, tricyclodecenyl acetate, tricyclodecenyl propionate, 4-(4-hydroxy-4-methylpentyl)-3-cyclohexenecarbaldehyde, 4-(4-methyl-3-pentenyl)-3cyclohexenecarbaldehyde, 4-acetoxy-3-pentyl-tetrahhydropyran, methyl dihydrojasmonate, 2-n-heptylcyclopentanone, 3-methyl-2-pentyl-cyclopentanone, n-decanal, n-dodecanal, 9-decenol-1, phenoxyethyl isobutyrate, phenylacetaldehyde dimenthyl acetal, phenylacetaldehyde dicetyll acetal, geranonitrile, citronellonitrile, cedryl acetate, 3-isocamphyl-cyclohexanol, cedryl ether, isolongifolanone, aubepine nitrile, aubepine, heliotropine, coumarin, eugenol, vanillin, diphenyl oxide, hydroxycitronellal, ionones, methyl ionones, isomethyl ionones, irones, cis-3-hexenol and esters thereof, indane musks, tetralin musks, isochroman musks, macrocyclic ketones, macrolactone musks, ethylene brassylate, aromatic nitromusk. Compositions herein typically comprise from 0.1% to 2% by weight of the total composition of a perfume ingredient, or mixtures thereof, preferably from 0.1% to 1.0%. In the case of the preferred embodiment containing peroxide, the perfumes must be chosen so as to be compatible with the oxidant. In a preferred execution, the perfume ingredients are hydrophobic and highly volatile, e.g., ingredients having a boiling point of less than about 260° C., preferably less than about 255° C.; and more preferably less than about 250° C., and a ClogP of at least about 3, preferably more than about 3.1, and even more preferably more than about 3.2.

The logP of many ingredients has been reported; for example, the Pomona92 database, available from Daylight Chemical Information Systems, Inc. (Daylight CIS), Irvine, Calif., contains many, along with citations to the original literature. However, the logp values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G.

Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The compositions herein can comprise a variety of other optional ingredients, including further actives and detergent builder, as well as mere aesthetical ingredients. In particular the rheology of the compositions herein would be suitable for suspending particles in the composition, e.g., particles of abrasives.

Detergent builders that are efficient for hard surface cleaners and have reduced filming/streaking characteristics at the critical levels are another optional ingredient. Preferred detergent builders are the carboxylic acid detergent builders described hereinbefore as part of the polycarboxylic acid disclosure, including citric and tartaric acids. Tartaric acid improves cleaning and can minimize the problem of filming/streaking that usually occurs when detergent builders are added to hard surface cleaners.

The detergent builder is present at levels that provide detergent building, and, those that are not part of the acid pH adjustment described hereinbefore, are typically present at a level of from about 0.1% to about 0.3%. more preferably from about 0.2% to about 2%, and most preferably from about 0.5 to about 1%.

The compositions herein can also contain other various adjuncts which are known to the art for detergent compositions. Preferably they are not used at levels that cause unacceptable filming/streaking.

Non-limiting examples of other adjuncts are: enzymes such as proteases; hydrotropes such as sodium toluene sulfonate, sodium cumene sulfonate and potassium xylene sulfonate; thickeners at a level of from about 0.01% to about 0.5%, preferably from about 0.05% to about 0.4%; and aesthetic-enhancing ingredients such as colorants, providing they do not adversely impact on filming/streaking.

Antibacterial agents, in addition to the cationic ones described hereinbefore, can be present, but preferably only at levels below about 0.5%, preferably below about 0.4%, to avoid filming/streaking problems. More hydrophobic antibacterial/germicidal agents, like orthobenzyl-para-chlorophenol, are avoided. If present, such materials should be kept at levels below about 0.1%.

Composition Making:

The compositions herein can be made by mixing together all ingredients. In general, a preferred order of addition is to first incorporate water, alkyl aryl sulfonate surfactant and organic acid, followed the hydrophobic cleaning solvent. Once the solvent is added, pH is adjusted to optimum as desired by the formulator. Optional cationic surfactant, peroxide, polymer, perfume and dye can then be added.

As used herein, all numerical values are approximations based upon normal variations, all parts, percentages, and ratios are by weight unless otherwise specified, and all patents and other publications are incorporated herein by reference.

Soap Scum Cleaning: Standard soiled plates that are used to provide a reproducible, standard soiled surface are treated with each product and the surface is then wiped with a sponge using a Gardner Straight line Washability Machine. The number of strokes required for complete cleaning is measured and recorded. The soap scum cleaning index is calculated using the following equation: (# strokes for control product/# strokes for experimental product) * 100, where the control product is Dow Bath Room® aerosol and the experimental prototypes are compositions 1–8 disclosed herein. Indices greater than 100 are suggestive of products with superior soap scum removal properties.

Hard Water Cleaning: Four marble chips for each product tested of approximate dimensions ¾"×¾"×¼" are weighed to four decimal places using an analytical balance. The chips are then placed in 100 ml beakers containing 20 grams of product for a total of 10 minutes. The marble chips are then removed, rinsed and allowed to dry. They are then re-weighed and the weight lost is computed. Using averages of four trials for each product, the hard water removal index is computed as follows: (average weight loss of the marble chips immersed in the control product/average weight loss of the marble chips immersed in the experimental compositions) * 100.

Soap scum removal and hard water removal test comparisons are made versus a commercially available product Dow Bath Room® aerosol.

EXAMPLES

The present invention is further illustrated by the following examples. The following compositions are made by mixing the listed ingredients in the listed proportions in the listed order of addition.

| | Composition | | | | | |
|---|---|---|---|---|---|---|
| Ingredient | 1 | 2 | 3 | 4 | 5 | 6 |
| $C_{12}$LAS* | 1.6 | 1.6 | 1.6 | 1.6 | 1.6 | 1.6 |
| $C_{12-14}$Alkyl sulfate | 1.0 | 1.0 | 1.0 | 1.0 | 1.0 | 1.0 |
| Bardac 208M ®** | — | — | — | — | 0.2 | 0.2 |
| n-BPP*** | 4.5 | 4.5 | 4.5 | 4.0 | 4.5 | 4.0 |
| Citric acid | 4.5 | 4.5 | 4.5 | 4.5 | 4.5 | 4.5 |
| Ammonia (pH adjust to 3.0) | 0.3 | 0.3 | 0.3 | 0.3 | 0.3 | 0.3 |
| Xanthan gum | — | 0.01 | 0.05 | 0.01 | 0.01 | 0.01 |
| Polyvinyl pyrrolidone | — | — | — | 0.05 | — | 0.1 |
| Perfume | 0.2 | 0.2 | 0.2 | 0.2 | 0.2 | 0.2 |

* LAS: $C_{12}$ Linear alkyl benzene sulfonate (Calsoft L-40 ® from Pilot)
**Bardac 208M ® is a mixture of quaternary ammonium surfactants sold by Lonza, Incorporated.
***n-BPP: Dipropylene glycol n-butyl ether (Dowanol DPnB ® by Dow Chemical)
†Composition does not fully remove soap scum The above formulations were tested versus Dow Bath Room® aerosol, the leading bath room cleaner in the U.S. Tests included an evaluation of hard water performance and soap scum.

| | | | | | | |
|---|---|---|---|---|---|---|
| Soap scum removal Cleaning Index | 280 | 280 | 280 | 250 | 250 | 250 |
| Hard water removal Cleaning Index | 350 | 370 | 300 | 350 | 210 | 250 |

What is claimed is:

1. An acidic hard surface cleaning composition which comprises:

a. from about 0.5% to about 5% alkyl aryl sulfonate detergent surfactant;

b. from about 1% to about 8% of hydrophobic cleaning solvent selected from the group consisting of: di-propylene glycol mono-butyl ether; tri-propylene glycol mono-butyl ether; ethylene glycol mono-hexyl ether; and mixtures thereof;

c. optionally, from about 0.25% to about 4% of an anionic cosurfactant selected from the group consisting of: $C_8$–$C_{18}$ linear or branched alkyl sulfates; $C_8$–$C_{18}$ alkyl ethoxy sulfates; and mixtures thereof;

d. optionally, from about 0% to about 2% nonionic alcohol and/or cationic surfactant;

e. from about 2% to about 8% of water soluble polycarboxylic acid;

f. optionally, from about 0.05% to about 5%, of hydrogen peroxide;

g. from about 0.001% to 0.5%, of a hydrophilic polymer selected from the group consisting of: xanthan gum; polystyrene sulfonate; polyvinyl pyrrolidone; polyvinyl pyrrolidone acrylic acid copolymer; polyvinyl pyridine; polyvinyl pyridine n-oxide; and mixtures thereof; and h. the balance an aqueous solvent system, and wherein the cleaning compositions are in micellar phase with a composition pH of from about 2 to about 4.

2. A composition according to claim 1 which comprises (a) from about 1% to about 4.5% by weight of the composition of alkyl aryl sulfonate surfactant; (b) from about 2% to about 6% by weight of the composition of one, or more, hydrophobic cleaning solvents; and (e) from about 2% to about 6% by weight of the composition of citric acid; (g) from about 60% to about 90% by weight of the composition of said aqueous solvent system, said composition having a pH of about 3.

3. A composition according to claim 2 which comprises from about 1.2% to about 4% by weight of the composition of alkyl aryl sulfonate surfactant; (b) from about 3% to about 6% by weight of the composition of one, or more, hydrophobic cleaning solvents; (e) from about 3% to about 5% by weight of the composition of citric acid; and (h) from about 60% to about 90% by weight of the composition of said aqueous solvent.

4. A composition according to claim 3 wherein said alkylaryl sulfonate detergent surfactant is an alkylbenzene sulfonate wherein said alkyl group contains from about 8 to about 14 carbon atoms.

5. A composition according to claim 3 that additionally comprises: (c) from about 0.25% to about 4% by weight of the composition of an anionic cosurfactant selected from the group consisting of: $C_8$–$C_{18}$ linear or branched alkyl sulfates; $C_8$–$C_{18}$ alkyl ethoxy sulfates; and mixtures thereof.

6. A composition according to claim 5 that additionally comprises (d) from an effective amount to provide increased viscosity to 2% by weight of the composition of nonionic alcohol and/or cationic surfactant wherein said nonionic alcohol is a linear, or mono-branched alcohol containing from about 8 to about 16 carbon atoms and/or wherein said cationic surfactant contains a hydrophobic chain containing from about 8 to about 16 carbon atoms.

7. A composition according to claim 6 wherein said cationic surfactant is selected from the group consisting of: $C_8$–$C_{18}$ tri alkyl ammonium chloride, $C_8$-$C_{12}$ dialkyl dimethyl ammonium chloride, $C_8$–$C_{18}$ alkyl benzyl dimethyl ammonium chloride and $C_8$–$C_{18}$ alkyl pyridinium dimethyl ammonium chloride.

8. A composition according to claim 7 that additionally comprises from about 0.001% to about 0.1% hydrophilic polymer.

9. A composition according to claim 8 that comprises from about 0.01% to about 0.05% of said hydrophilic polymer.

10. A composition according to claim 5 that additionally comprises: (g) from about 0.001% to about 0.1% by weight of one, or more, hydrophilic polymers selected from the group consisting of: xanthan gum; polystyrene sulfonate; polyvinyl pyrrolidone; polyvinyl pyrrolidone/acrylate copolymer; polyvinyl pyridine; polyvinyl pyridine n-oxide; and mixtures thereof.

11. A composition according to claim 3 that additionally comprises: (f) from about 0.05% to about 5% by weight of the composition of hydrogen peroxide.

12. A composition according to claim 3 that additionally comprises: (g) from about 0.001% to about 0.1% by weight of one, or more, hydrophilic polymers selected from the group consisting of: xanthan gum; polystyrene sulfonate; polyvinyl pyrrolidone; polyvinyl pyrrolidone/acrylate copolymer; polyvinyl pyridine; polyvinyl pyridine n-oxide; and mixtures thereof.

13. A composition according to claim 12 wherein said hydrophilic polymer is present at from about 0.01% to about 0.05% by weight of the composition.

14. A composition according to claim 1 wherein said hydrophobic cleaning solvent is dipropylene glycol n-butyl ether.

15. A composition according to claim 14 containing citric acid as a pH adjuster and having a pH of about 3 or less.

16. A composition according to claim 1 wherein said polycarboxylic acid is selected from the group consisting of: citric acid and mixtures of succinic, adipic and glutaric acid.

17. A composition according to claim 1 wherein said hydrophobic solvent is dipropylene glycol n-butyl ether and said polycarboxylic acid is citric acid.

18. A composition according to claim 1 that additionally comprises (d) from an effective amount to provide increased viscosity to 2% by weight of the composition of nonionic alcohol and/or cationic surfactant wherein said nonionic alcohol is a linear, or mono-branched alcohol containing from about 8 to about 16 carbon atoms and/or wherein said cationic surfactant contains a hydrophobic chain containing from about 8 to about 16 carbon atoms.

19. A composition according to claim 18 wherein said cationic surfactant is selected from the group consisting of: $C_8$–$C_{18}$ tri alkyl ammonium chloride, $C_{8-12}$ dialkyl dimethyl ammonium chloride, $C_8$–$C_{18}$ alkyl benzyl dimethyl ammonium chloride and $C_1$–$C_{18}$ alkyl pyridinium dimethyl ammonium chloride.

20. A composition according to claim 1 that comprises from about 0.001% to about 0.1% hydrophilic polymer.

21. A composition according to claim 20 that comprises from about 0.01% to about 0.05% of said hydrophilic polymer.

22. The process of cleaning a surface comprising applying an effective amount of the composition of claim 1 to said surface and rinsing said surface.

23. The process of claim 22 wherein said surface is soiled with mildew and said composition contains an effective amount of hydrogen peroxide.

24. The process of claim 22 wherein said surface is soiled with mildew and said composition contains an effective amount of cationic surfactant.

* * * * *